United States Patent [19]

Kaufman

[11] Patent Number: 4,830,674

[45] Date of Patent: May 16, 1989

[54] DELAMINABLE RESERVOIR FOR SCRUBBING IMPLEMENTS

[76] Inventor: Jack W. Kaufman, 367 Frankel Blvd., Merrick, N.Y. 11556

[21] Appl. No.: 129,652

[22] Filed: Dec. 7, 1987

[51] Int. Cl.[4] ..... A46B 11/02

[52] U.S. Cl. ..... 134/16; 15/104.94; 15/114; 15/116.2; 15/118; 15/119 A; 15/244.1

[58] Field of Search ..... 15/187, 104.94, 114, 15/118, 116 A, 119 A, 244 B, 244 C; 401/28, 291; 134/16

[56] References Cited

U.S. PATENT DOCUMENTS

| | | | |
|---|---|---|---|
| 3,966,335 | 6/1976 | Abramson | 15/114 |
| 4,181,446 | 1/1980 | Kaufman | 15/114 |
| 4,480,351 | 11/1984 | Kaffler | 15/187 |

*Primary Examiner*—Asok Pal

*Attorney, Agent, or Firm*—Seymour G. Bekelnitzky

[57] ABSTRACT

An article for use in brushing and scrubbing surfaces with flowable materials comprising an easily delaminable reservoir for said flowable materials which, as required, will supply the materials in unreduced strength to disposable scrubbing implements for the application of said materials to, and scrubbing and brushing of surfaces, said reservoir comprising:

(a) a first member comprising a semi-rigid flat sheet; and (b) a formed second member comprising a cavity comprising a bottom wall, a circumferential side wall depending perpendicularly from said bottom wall and terminating at its upper end in a circumferential flange extending outward from said normal to said upper end and a top opening coplanar with the upper surface of said flange, the first and second members of said reservoir being delaminable upon the application of a slight pressure to said first member adjacent said cavity; wherein said first member is in adherent contact with said the flange of said second member adherence being effected by means of heat sealing or adhesives; and, if desired, said first member may be longer and/or wider than said flange.

12 Claims, 4 Drawing Sheets

DELAMINABLE RESERVOIR FOR SCRUBBING IMPLEMENTS

BACKGROUND OF THE INVENTION

This invention relates to articles for brushing and scrubbing surfaces, with flowable materials such as soaps, germicides and antiseptics. More particularly, it refers to delaminable reservoirs, for use in connection with scrubbing implements, containing such flowable materials, and, when required, prior to use, supplying same to the scrubbing implement said reservoir comprising a sealed container, to contain said flowable materials, said container comprising a first member comprising a semi-rigid flat sheet and a formed second member comprising a flexible sheet, the upper surface of which is in adherent contact with the lower surface of said first member comprising a recess, to contain said flowable materials, said recess comprising a bottom wall, a circumferential side wall approximately perpendicular to said bottom wall; and a flange approximately perpendicular to and extending outward from the top of said circumferential side wall and a top opening coplanar with the upper surface of said flange and the top of said circumferential side wall; the seal between the side and proximal end portions of said second member flange and the underside of said first member being delaminable upon application of slight pressure to the portion of said first member adjacent said recess whereby the flowable material is expelled from said recess and enters said implement just prior to being used in scrubbing and brushing the desired surface. In this manner the materials are protected from the atmosphere and other possible deleterious materials and the shelf life of said implement is limited primarily by the shelf life of the flowable materials within said reservior.

In U.S. Pat. No. 4,181,446,issued to the instant Applicant (and incorporated herein by reference) there is disclosed "[a] brush construction . . . " (Claim 1) "the sponge or pad [of which] may be impregnated with or otherwise carry a supply of soap, detergent germicide or antiseptic for dispersion therefrom to the surface being scrubbed . . . " (Column 3 lines 11 to 14.)

However, when thusly impregnated and stored for lengthy periods, prior to use, said scrubbing implements lose their efficiency due to poor shelf life. For instance, the antiseptic expressed from a scrubbing implement previously impregnated with a 0.75% solution of Povidone TM -iodine was found to contain only about 0.02% of said Povidone TM -iodine after storage.

In addition, the packaging of said scrubbers comprised materials of construction which had poor vapor barrier properties with respect to the dispersants and/or solvents for the active ingredients. As a consequence, the additive composition of implements dried out further decreasing the efficacy thereof.

It has now been found that the scrubber system of the instant invention ameliorates or eliminates the above problems.

SUMMARY OF THE INVENTION

It is an object of the invention to provide a scrubbing implement useful in the scrubbing and brushing of and application of flowable materials to surfaces said system having a relatively long shelf life.

It is another object of the invention to provide a scrubbing implement as described above comprising flowable materials, to be applied to surfaces, the shelf life of said system being limited only by the shelf life of said flowable material.

Yet another object of the invention is to provide low cost, single use scrubbing and brushing implements comprising scrubbing and brushing elements, such as bristles and absorbent pads with fluid connection therebetween to effect application of flowable materials to, and brushing and scrubbing of surfaces.

Another object of the invention is to provide a scrubbing and brushing implement as described above comprising a sealed reservoir for said flowable material said reservoir being openable upon slight pressure, e.g., from a finger, upon the top wall of said reservoir, adjacent said recess whereby said reservoir deforms and said seal is delaminated whereby said flowable material escapes from said reservoir impregnates the pad of said implement just prior to use of the implement.

Yet another object of the invention is to provide an article, for use in scrubbing and brushing surfaces, such as is described above, including a container to maintain said article clean and to provide a single, throwaway unit.

Other objects will be in part apparent and in part specifically disclosed in connection with the following detailed description and the accompanying drawings.

DETAILED DESCRIPTION OF THE PREFERRED EMBODIMENT

Figure 1:
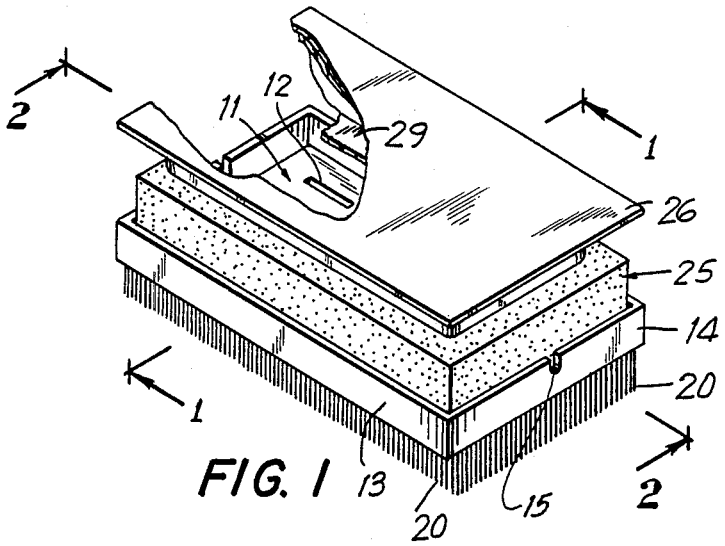
FIG. 1 is a top perspective view of a scrubbing article comprising the scrubbing implement of the prior art and the reservoir of the instant invention partially broken away to show internal structure.

FIG. 1 illustrates a scrubbing article for use in scrubbing and brushing of surfaces, e.g., prior to surgery, comprising the combination of the delaminable reservior 40 of the instant invention together with a scrubbing implement such as that disclosed in U.S. Pat. No. 4,181,446, issued to the instant Applicant (and incorporated herein by reference), wherein the absorbent pad thereof may be impregnated with flowable materials such as soaps, detergents, germicides or antiseptics.

Figure 2:
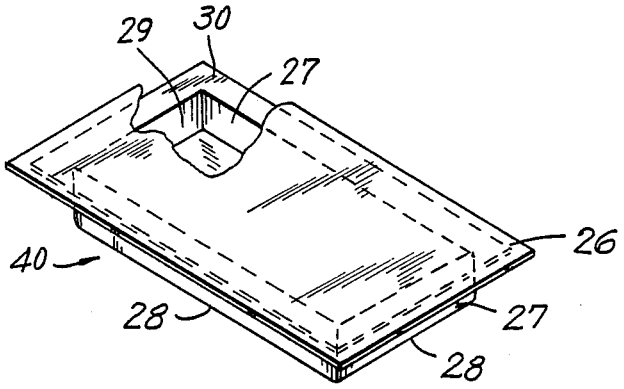
FIG. 2 is a top perspective view of the reservoir of the invention partially broken away to show internal structure.
Figure 3:
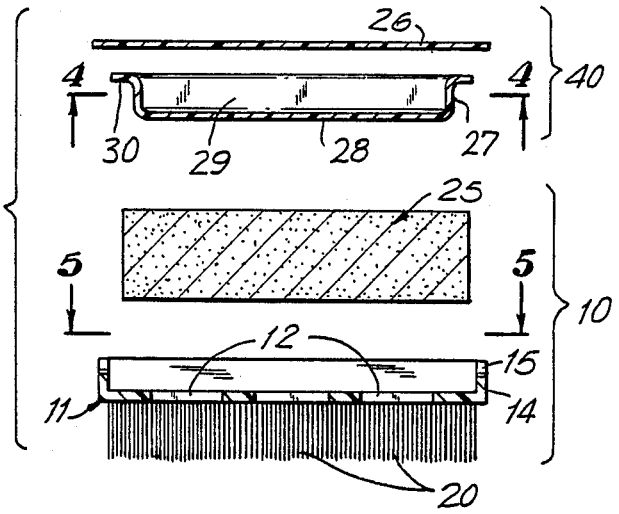
FIG. 3 is an exploded side elevational cross-sectional view along line 2—2 of FIG. 1.
Figure 4:
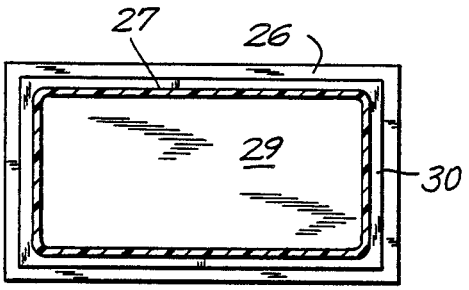
FIG. 4 is a bottom view along line 4—4 of FIG. 3.
Figure 5:
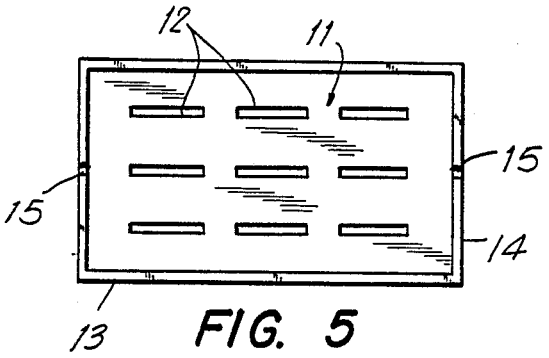
FIG. 5 is a top view along line 5—5 of FIG. 3.
Figure 6:
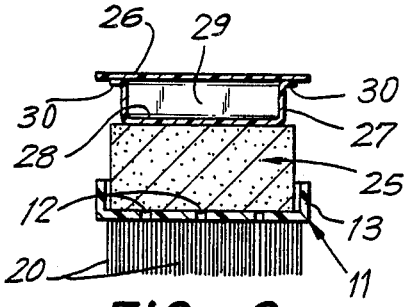
FIG. 6 is an elevational cross-sectional front view along line 1—1 of FIG. 1.
Figure 8:
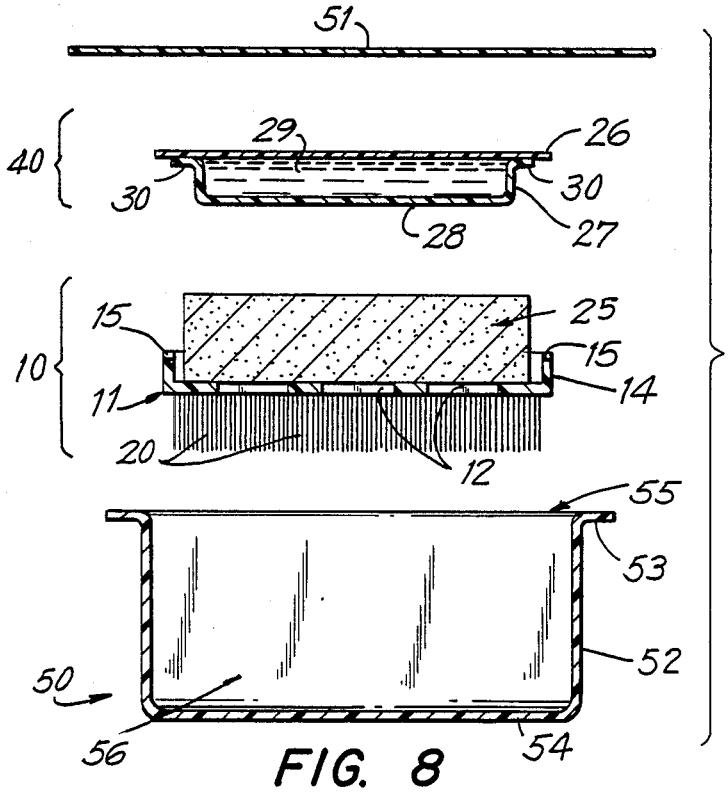
FIG. 8 is an exploded version of FIG. 7.

Thus, in FIGS. 2 and 8 the numeral 40 identifies a reservoir for said flowable materials which releases said flowable materials to the scrubbing implement 10 just prior to use. (Throughout this Specification the same number will refer to the same element in all embodiments.)

The reservoir 40 comprises a container for said flowable materials comprising a first member comprising a semi-rigid sheet 26, delaminably sealed to a formed second member 45 comprising a semi-flexible sheet comprising a recess 29 to contain said flowable materials, a bottom wall 28, a circumferential side wall 27 approximately perpendicular thereto, a flange 30 approximately perpendicular to and extending outward from said circumferential side wall and a top opening 31 coplanar with the upper surface of said flange.

The seal between said members is comprised of materials easily delaminated, upon application of slight pressure, e.g., from a finger, to the contents of said recess, to release the flowable materials contained therein. Preferably, the length and width of said first member is greater than the length and width of said second member to whereby an overhang is formed to direct the flowable materials, upon release from the reservior 40, into the pad 25 of the scrubbing implement rather than away therefrom.

The seal between said first member 26 and the flange 30 of the second member is effected either by heat sealing or by means of adhesives said seal being delaminable upon application of slight pressure thereto through the material within the reservoir. If said binding is effected by means of an adhesive, said adhesive must be one, as known to the art, which is not reactive with said flowable materials thereby preventing a decrease in the efficiency of said flowable materials either by preventing diffusion and leaking through said adhesive or by reaction therewith.

The materials of construction of said reservior 40 will also be chosen by the user in accordance with the properties required, e.g., compatability with the flowable materials, sufficient flexibility in the first member to permit pressure to be transmitted therethrough into the flowable materials contained within the reservoir and therethrough to said seal to cause delamination of the bond between said first and second members and high vapor impermeability, for all of the walls, to both internal and external vapors, to increase the shelf life of the flowable materials.

The scrubbing implement to which said reservoir 40 supplies said flowable materials may be exemplified by that disclosed in the afore-mentioned Patent.

The combination of reservoir 40 and scrubbing implement is illustrated in FIGS. 1 and 3 to 6 wherein said implement comprises a generally flat plate or body 11 defining a brush back, which may be normally flat and of elongate, say of rectangular outline configuration, but without limitation thereto. The normally flat brush back 11 will be formed with openings or perforations therethrough, such as slots 12 extending generally longitudinally of the brush back. The openings or slots 12 may serve to pass flowable materials such as soaps, detergents, germicides, antiseptics, and the like, and mixtures thereof between opposite sides of the brush back, as will be more fully apparent hereinafter.

The normally generally flat brush back 11 may be fabricated of a suitable plastic material being self sustaining in its normally flat condition, and having flexibility enabling the brush back to be bent or folded upon itself, say to an obtuse angle when desired.

In the illustrated embodiment, the brush back 11 is of generally rectangular outline configuration, and provided on opposite side edges with upstanding longitudinal ribs or flanges 13. The longitudinal ribs or flanges 13 define upstanding side walls and effectively stiffen the brush back 11 against flexure or bending about a laterally extending or transverse axis.

Additionally, extending along each end edge of brush back 11 is an upstanding end wall, rib, or flange 14 extending between and integral at its opposite ends with the adjacent ends of side flanges 13. Each end rib or flange 14 may be notched, cut away or interrupted in a medial region, as at 15, notches 15 being generally aligned longitudinally of the brush back 11.

Thus, the ribs or flanges 13 and 14 combine to define a generally circumferential upstanding wall about the upper or outer face of brush back 11. Further, the brush back 11 and the circumferential wall or flange 13, 14 may advantageously be integrally fabricated of plastic, as by suitable mass production techniques, say injection molding, or the like.

It will be apreciated that the circumferential flange or wall 13, 14 effectively stiffens or rigidifies the brush back 11 against flexure, except along a longitudinally medially extending region of the brush back between the notches or cut out 15. Thus, the longitudinally extending medial region 16 of the brush back 11, between the notches 15, is bendable or foldable to swing the remaining portions of the brush back upwardly toward each other. In this condition, the adjacent flange portions 17 on opposite sides of each cut out 15 may swing into overlapping relation.

In addition, on the underside of brush back 11, projecting downwardly and outwardly therefrom, generally normal thereto, are a multiplicity of projections or bristles 20. In practice, the bristles may be molded integral with and project in row from the undersurface of brush back 11, generally in the direction away from the upstanding circumferential flange 13, 14. While the bristles 20 are flexible, they generally move with the adjacent or contiguous portion of brush back 11, remaining generally normal thereto, so that certain bristles swing in angular relation with respect to other bristles. That is, the bristles 20 depending from the brush back 11 on one side of the medial longitudinal brush back region 16 swing in angular relation away from the bristles depending from the brush back region on the other side of the medial location.

As described hereinbefore, the brush back 11, circumferential flange 13, 14 and bristles 20 may all be integrally molded say of plastic, as a single unit for efficient and economical production. In addition, there may be provided or secured a rubbing pad or sponge 25 seated on the upper side or surface of brush back 11 conformably within the circumferential flange 13, 14. In the illustrated embodiment the rubbing pad or sponge 25 is of generally rectilinear configuration and snugly engaged within the circumferential wall 13, 14 to be effectively retained thereby. If desired, the sponge or pad 25 may be impregnated with or otherwise carry a supply of said flowable materials for dispersion therefrom to the surface being scrubbed, as directly from the sponge and through openings 12 to the bristles 20. The sponge or rubbing pad 25 is of a flexibility consistent with the desired manual flexibility of brush back 11, so that simultaneous flexure of both the brush back and sponge may be readily manually accomplished, while the sponge may serve to enhance the restoring force, so that the brush back 11 returns with suitable rapidity to its generally flat planar condition.

In using the present invention said reservoir 40 is positioned with the bottom wall 28 of the second member 45 thereof in contact with the upper surface of the pad 25. Pressure is applied to the topwall, or first member 26, of said reservoir, through the flowable materials contained therein, to the seal between said first and second members which are thereby caused to delaminate expelling said flowable materials to, and are which are absorbed within, said pad 25 and partially expressed therefrom through the apertures 12 to the bristles 20 and then to the surface to be scrubbed. The oversized first member 26 directs the expelled flowable materials onto said brush 25.

The materials of construction for the scrubbing implement will be chosen by the user according to his specific needs. However, by virtue of the shorter time of contact of said flowable materials therewith the limitations on such choices might be less than when the pad 25 is impregnated with said flowable materials and stored.

Figure 7:
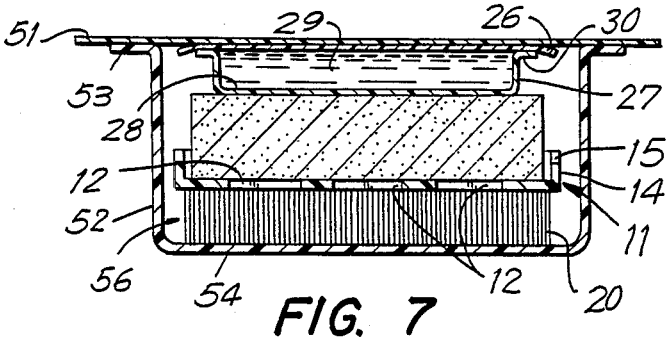
FIG. 7 is a cross-sectional elevational side view of another embodiment of the invention.

In another embodiment of the invention, illustrated in FIGS. 7 and 8 there is provided a scrubbing and brushing article comprising the above elements of a brushing implement comprising the back 11 and bristles 20, the pad 25 and the reservoir 40 and a container therefor. Said container comprises a formed second member comprising a cavity 56 into which said elements are inserted, a bottom wall 54, circumferential wall 52 approximately perpendicular thereto said wall 52 terminating in a flange 53 approximately normal to and extending outward from said wall 52. Said container further comprises a top opening 55 coplanar with the upper surface of said flange 53.

The container further comprises a first member comprising a semi-rigid approximately flat sheet the sides and proximal end portion of which are peelably adherent to the proximal end portions of the flange 53 of the second member, said adherence being achieved either by heat sealing or adhesives. The unsealed distal end portions said first and second members provide means for gripping said members and peeling them apart.

In this instance, also, the materials of construction will be selected according to the requirements of the user. However, those requirements will not be as stringent as for the aboveindicated elements as contact with the flowable materials will not occur until just prior to use and shortly thereafter the container will be discarded.

Thus, compatability of the materials of construction with the flowable materials will probably not be significant while their physical properties and the cost of manufacturing the container will be. Furthermore, vapor barrier properties will also not be significant except to the extent the container must exclude vaporous contaminants from the scrubbing implement.

The strength of the bond between said first 51 and second members of said container must be such that the pressure applied to the portion of said first member of the of the container adjacent the first member 26 of said reservoir will not cause delamination of the members of the container.

If the first 51 and second 50 members of said container are to be peeled apart before delamination of the members of the reservoir the first member 51 of said container need not have any particular degree of flexibility.

If, however, as is preferable the delamination of the members of the reservoir is to occur before the separation of the members of the container the strength of the bond between the members must be greater than that between the members of the reservoir. Furthermore, the first member 51 of the container must have sufficient flexibility to permit slight pressure applied to the upper surface thereof, adjacent said recess 29 in the reservoir 40, to be transmitted therethrough to and through the first member 26 and contents of said reservoir whereby the first 26 and second 45 members of said reservoir delaminate permitting the contents of said reservoir to be expelled therefrom to the scrubbing element with no diminution in their desired properties.

In this embodiment, after separation of the members of said container the second member 50 thereof will also provide a resting support for said scrubbing implement to preclude the necessity of resting it directly on other surfaces whereby said surfaces are protected from soiling by the implement and/or the implement is protected from contamination by substances on the surfaces.

Another embodiment of the invention comprising use of the article of the first embodiment comprises the steps of:

(a) placing said reservoir 40 adjacent to the upper surface of said pad 25 the bottom wall 28 of said reservoir being in contact with said pad surface;
(b) applying pressure to the first member 26 of said reservoir whereby the first 26 and second 45 members thereof are caused to delaminate and the flowable materials contained within said reservoir expelled into said pad 25;
(c) removing said reservoir now completely or partially emptied;
(d) applying said flowable materials to, and brushing and scrubbing the desired surface by means of the scrubbing implement.

Yet another embodiment of the invention using the scrubbing implement of the second embodiment thereof comprises the steps of:

(a) applying pressure to the outer surface of the first member 51 of said container and therethrough to the outer surface of the first member 26 of said reservoir 40 whereby the whereby the first 26 and second 45 members thereof are caused to delaminate thereby permitting the flowable materials contained therein into the pad 25, the overhanging portion, if present, of first member 26 causing said flowable materials to flow into said pad 25 rather than outward to the cavity of the container;
(b) peeling the first member 51 from the second member 50 of the container;
(c) removing said first 51 and second 50 members of said container and said reservoir 40 from said scrubbing implement; and
(d) applying said flowable materials to, and brushing and scrubbing, the desired surfaces by means of the scrubbing implement.

The above described combinations of scrubbing reservoir are of non-complex structure, high and by virtue of their low costs of manufacturing one-shot (i.e. disposable) use.

The above detailed descriptions are only for illustration and changes and modifications thereto within the spirit of this invention.

What is claimed is:

1. An easily delaminable reservoir for flowable materials for use in an article in brushing and scrubbing surfaces with said materials which, as required, will supply the materials in essentially unreduced strength to disposable scrubbing implements for the application of said materials to, and scrubbing and brushing of surfaces, said reservoir comprising:

(a) a first member comprising a semi-rigid flat sheet; and
(b) a formed second member comprising a cavity comprising a bottom wall, a circumferential side wall depending perpendicularly from said bottom wall, said side wall terminating at its upper end in a circumferential flange extending outward from and normal to said upper end and a top opening coplanar with the upper surface of said flange; said first and second members being delaminable upon the application of a slight pressure to the upper side of said first member adjacent said recess; wherein said first member is in adherent contact with the flange of said second member adherence being effected by means of heat sealing or adhesives; wherein said first and second members being capable of being separated by slight pressure to the upper side of said first member, and, if desired, said first member may be longer and wider than said flange.

2. The article of claim 1 wherein said scrubbing implements comprise:

(a) brushing means;

(b) scrubbing means; and (c) supporting means, comprising apertures, interposed between said brushing and scrubbing means and providing fluid connection therebetween.

3. The article of claim 1 wherein said adherence is effected by heat sealing.

4. The article of claim 1 wherein said first member is longer and wider than the flange.

5. The article of claim 1 wherein said first member is longer than the flange.

6. The article of claim 1 wherein said first member is wider than the flange.

7. The article of claim 1 further comprising an outer container for the combination of said brush-scrubber implement and reservoir said container comprising:

(a) a first member comprising a semi-rigid flat sheet; and (b) a formed second member comprising a cavity comprising a bottom wall, a circumferential side wall depending perpendicuarly from said bottom wall and terminating at its upper end in a circumferential flange extending outward from and approximately normal to said upper end and a top opening coplanar with said flange; said first member and said flange being in adherent peelable contact wherein said adherence is effected by means of heat sealing or adhesives.

8. The article of claim 1 wherein said adherence is effected by means of adhesives which do not react with, and do not permit diffusion therethrough, of said flowable materials.

9. The article of claim 8 wherein said adherence is effected by means of adhesives which do not permit diffusion therethrough, of said flowable materials.

10. The article of claim 8 wherein said adherence is effected by means of adhesives which do not react with the flowable materials.

11. A method of applying flowable materials to, and brushing and scrubbing, surfaces comprising the steps of:

(a) placing the reservoir of claim 1 adjacent to the upper surface of the absorbent pad of the scrubbing implement the bottom wall of said reservoir being in contact with the top wall of said absorbent pad;

(b) applying pressure to the top wall of said reservoir whereby the first and second members of said reservoir are caused to separate, the recess is deformed and the flowable materials contained within said reservoir are expelled into said absorbent pad;

(c) removing said reservoir, now completely or partially emptied; and (d) applying said flowable materials to, and brushing and scrubbing, the appropriate surface with the scrubbing implement.

12. The method of claim 11 comprising the steps of:

(a) applying pressure to the outersurface of the first member of the container of claim 8 and through said member to the outer surface of the top wall of said reservoir whereby the first and second members of said reservoir are caused to separate, the recess is deformed expelling the flowable materials contained within said reservoir into the absorbent pad, the first member of said reservoir causing said flowable materials to flow into said absorbent pad rather than into the cavity of the container, (b) peeling the first member of the container from the second member thereof;

(c) removing the first and second members of said container and said reservoir from the scrubbing implement; and (d) applying said flowable materials to, and brushing and scrubbing, the desired surface by means of the scrubbing implement.

* * * * *